United States Patent [19]

Neukermans

[11] 4,038,665

[45] July 26, 1977

[54] RECORDING WITH DONOR TRANSFER OF MAGNETIC TONER

[75] Inventor: Armand P. Neukermans, Palo Alto, Calif.

[73] Assignee: Xerox Corporation, Stamford, Conn.

[21] Appl. No.: 616,969

[22] Filed: Sept. 26, 1975

[51] Int. Cl.[2] ..... G03G 19/00

[52] U.S. Cl. ..... 346/74.1; 118/647

[58] Field of Search ..... 346/74.1, 153, 162, 346/163, 160, 154, 150; 118/647, 649, 657, 661

[56] References Cited

U.S. PATENT DOCUMENTS

| | | | |
|---|---|---|---|
| 3,161,544 | 12/1964 | Berry | 346/74.1 |
| 3,566,789 | 3/1971 | Kaufer | 346/74.1 |
| 3,702,482 | 11/1972 | Dolcimascolo | 346/74 P |
| 3,852,525 | 12/1974 | Ichioka | 346/74.1 |
| 3,935,578 | 1/1976 | Condon | 346/74.1 |

*Primary Examiner*—Jay P. Lucas

*Attorney, Agent, or Firm*—James J. Ralabate; Richard A. Tomlin; Max J. Kenemore

[57] ABSTRACT

A method and apparatus for selectively transferring magnetic toner from a reservoir to the imaged areas of a copy web. The reservoir is used to develop a donor web in which a multiplicity of microfields have been recorded. The donor web is subsequently passed into non-contacting proximity to a copy web having a latent magnetic image thereon. The toner is selectively attracted to the stronger magnetic forces in the imaged areas of the copy web and remains on the donor web in the non-imaged areas. Another aspect of the invention provides for the neutralization of the donor web microfields prior to the toner transfer to enhance the development process.

26 Claims, 6 Drawing Figures

RECORDING WITH DONOR TRANSFER OF MAGNETIC TONER

BACKGROUND OF THE INVENTION

1. Field of the Invention

The invention generally pertains to process and apparatus for recording information on a copy sheet by magnetic imaging procedures and is more particularly directed to developing a magntic latent image with a magnetic toner.

2. Prior Art

The processes for providing latent images on a substrate or surface and then decorating them by a fine pigmented particulate (usually called a toner) to produce a visual image or one that is transferable to a copy sheet are well known in the art.

Generally, in the past, a number of development systems have been used to tone either an electrostatic latent image (zones having electric potential differences between image and non-image areas) or a magnetic latent image (zones having magnetic potential differences between image and non-image areas).

Normally, electrostatic and magnetic toners are not compatible. Electrostatic toners typically do not exhibit marked attraction to magnetic field forces because they are not ferromagnetic while magnetic toners are usually heavy and fairly conductive and are therefore not favored electrostatic charge carriers.

However, some ferromagnatic materials have been used in electrostatic development systems as carriers. These ferromagnetic carrier particles which are relatively large exhibit triboelectric attractions for smaller toner particles and are useful in transferring the toner to an electrostatic image. The toner particles are separated from the carrier by the stronger electrostatic forces on the latent images than the triboelectric forces between carrier and toner.

One example of a cascade development system employing ferromagnetic carrier to transfer a toner to an electrostatic latent image is U.S. Pat. No. 3,545,968 issued to Sato.

Another example of a development apparatus using a ferromagnetic carrier is U.S. Pat. No. 3,437,074 issued to Hgopian et.al. This reference describes a "magnetic brush" development system where the ferromagnetic carrier particles are formed into streamers or bristles and form a brush like mass.

A donor belt utilizing ferromagnetic carrier for toner tranfer in an electrostatic apparatus is disclosed in a U.S. Pat. No. 3,741,790 issued to Wu.

Such development systems rely n the electrostatic forces generated by potential differences in image areas to be stronger than the forces holding the toner particles to the carriers. The electrostatic forces generated by an electrostatic latent image are in fact much stronger than those which can be produced from a magnetic latent image and thus other methods had to be initiated to tone these magnetically.

This has led to the development of using ferromagntic particles in some form that are not just carriers but actual toners for developing a magnetic latent image. As in the electrostatic development area, there have been a plurality of methods proposed for the decoration of latent magnetic images by magnetic toner.

A cascade development system for magnetic images is illustrated in U.S. Pat. No. 3,250,636 issued to Wilferth. In this reference, magnetic particulate is poured or flooded over a surface containing a magnetic latent image. The toner adheres to the image areas and excess toner flows by gravity from the surface into a reservoir.

Another magnetic toner development system, in which the toner is caused to impinge on a magnetic latent image by flicking the toner from the bristle ends of a wire brush, is illustrated in U.S. Pat. No. 3,825,936 issued to Ott et.al.

Immersion techniques are also known in the art where a tape has a recorded image thereon immersed in a reservoir within a volatile fluid medium. Upon circulation of the fluid medium around the image, toner is attracted to magnetized areas of the image. An example disclosing such a technique is found in U.S. Pat. No. 3,740,265 issued to Springer.

All the aforementioned latent magnetic imaging development apparatus have the problem of contacting toner not only within imaged areas but also within non-imaged areas and thereby producing substantial background. (Toner adhered to non-image areas.)

This is detrimental to a magnetic imaging process as the forces holding the magnetizable particles to the image areas are not as great as those found in electrostatic system and hence background in more difficult to clean from an area after the toner deposition thereon.

A non-contact magnetic imaging system is illustrated in U.S. Pat. No. 3,849,161 issued to Klaenhammer. The system provides alternate magnetizations for image areas in relation to non-image areas. However, such a system is devoid of a process to produce the resolution needed by modern imaging applications in the commercial sector.

Therefore, it would be advantageous to have a clean development system that would also be capable of uniform image development and high resolution.

SUMMARY OF THE INVENTION

Accordingly, it is an object of the invention to provide an improved process and apparatus for toning or decorating a magnetic latent image with ferromagnetic particlate.

It is another object of the invention to provide a contactless toning system where only the image areas have particulate adhered thereto.

It is still another object of this invention to reduce background in the development of a latent magnetic image for a magnetic imaging system with high resolution capabilities.

It is a further object of the invention to provide a uniform supply of toner to a latent magnetic image to produce even image development.

These objects and others are accomplished in accordance with the invention by providing a donor surface which is magnetizable in an alternating pattern of magnetizations of a specified spatial wavelength. The donor surface is toned and then, with magnetic particulate adhering to the microfield pattern, transported into non-contacting proximity with a magnetizable copy surface. The copy surface has a latent magentic image recorded thereon which has a stronger magnetic force than that of the doner surface. The toner will be transferred by the differential in magnetic forces due to the fields produced between the copy and donor surfaces. Only the image areas of the copy surface will be toned as there are no magnetic force gradients in the non-image areas.

The toner transfer effect is magnified if the copy surface has higher coercivity than the donor surface according to one aspect of the invention. Another feature of the invention provides for the enhancement of the transfer process by the erasure or neutralization of thee doner surface microfields prior to the toner transfer with a remagnetization of the donor surface subsequent to transfer.

BRIEF DESCIPTION OF THE DRAWINGS

These and other objects, features and aspects of the invention will become clearer and more fully apparent from the following detailed description when read in conjunction with the accompanying drawings, wherein;

FIG. 1 is a schematic system diagram of a magnetic imaging apparatus employing a magnetic doner development process and apparatus in accordance with the present invention;

FIGS. 2A and B are representative pictorials of sections of the copy web and donor web of the apparatus of FIG. 1 illustrating imge domain magnetizations and pre-recorded microfields, respectively; and FIGS. 3A, B and C are alternative embodiments of the apparatus and method for preforming a toner transfer from the donor web to the copy web of the imaging system illustrated in FIG. 1.

DETAILED DESCRIPTION OF THE PREFERRED EMBODIMENTS

Figure 1:
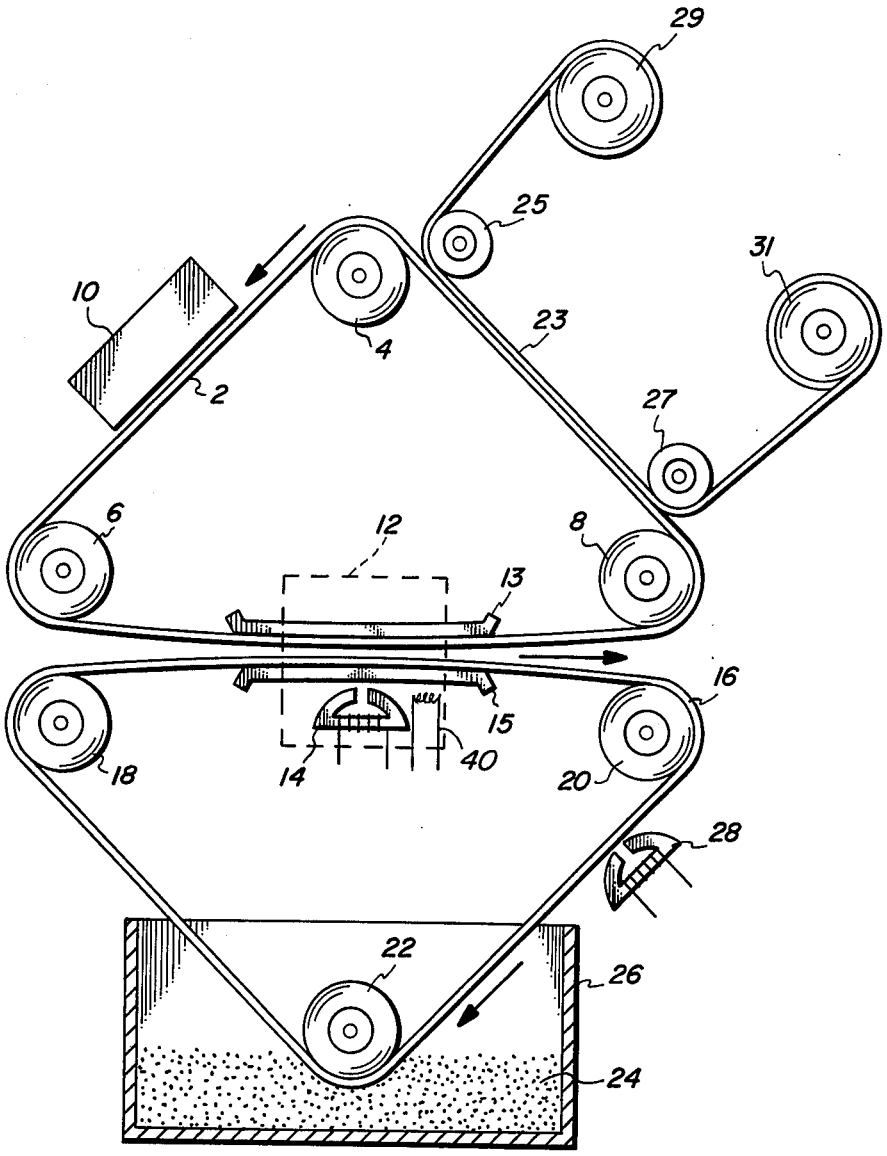

With reference now to FIG. 1 there is shown a magnetic imaging system incorporating the present invention. The magnetic imaging system includes a recording station 10 which produces a magnetic latent image on a copy web 2 in some manner.

There are a number of methods known in the art for accomplishing this process. Some examples are direct recording with a magnetic recording head, theremoremanent or anhysteretic copying from a recorded master tape, Curie point writing or erasure with masks or a laser, etc. The magnetic latent image that is formed by one of the above-described processes will be an alternating pattern of magnetizations in imagewise configuration. The non-imaged areas are not polarized in any magnetization direction and the magnetic material in them will produce no magnetic field gradients. The magnetic forces from the fringing fields of the magnetization pattern of the image are thus substantially the only attractive forces on the copy web surface.

The copy web 2 is generally a magnetic tape with a magnetizable surface area that has a coercivity and paramagnetic state that allow it to be magnetized in a magnetic image configuration as mentioned before.

Preferred choices for the copy web 2 would be $CrO_2$ tape sold under the tradename Crolyn by the DuPont corporation (Br = 1600 Gauss, Hc = 5400e, squareness = 0.9) or $\gamma Fe_2O_3$ tape sold as 3M777 by the 3M Corporation (Br = 1400 Gauss, Hc − 312 Oe, Squareness − 0.8).

The copy web 2 is entrained about copy web rollers 4, 6 and 8 in an endless belt fashion where at least one of the copy web rollers 4, 6 and 8 may be driven by conventional motors or other means (not illustrated). Once the copy web has a latent magnetic image produced thereon the image is transferred by the rotation of the rollers into a toner transfer area 12 where it is decorated with a ferromagnetic particular tner 24 from a reservoir 26. The toners that may be used in the practice of the invention are ones loaded with soft magnetic material or those loaded with unpoled hard magnetic materials. Toners such as these are described in U.S. Pat. Nos. 3,639,245; 2,932,278; 3,052,564 and 3,250,636 the disclosure of which is herein incorporated by reference.

The magnetic toner 24 is transported to the toner transfer area 12 by means of a doner web 16 entrained about three doner web rollers 18, 20 and 22. The doner web 16 froms an endless belt around the doner web rollers 16, 18 and 20. At least one of the doner web rollers drives the doner web 16 and is able to transport the magnetic toner into the toner transfer area 12.

The doner web 16 is generally a magnetic tape with a magnetizable surface area that has a coercivity and paramagnetic state that allow it to be magnetized in a microfield pattern of alternating magnetization. Preferred choices are those that have been mentioned above for the copy web 2 and include Crolyn and 3M777. Additionally, one could use a $\gamma Fe_2O_3$ tape sold as 3M206 by the 3M Corporation (Br = 1303 Gauss, Hc = 3320E, squareness = 0.8). This tape has a thicker magnetizable layer ($14\mu$) than the others mentioned and can be used when longer doner web wavelengths are chosen.

The transportation of toner takes place from the reservoir 26 to the transfer area 12 because the doner web has a magnetizable surface containing a magnetic pattern which attracts the toner while it is driven over the doner web roller 22.

The toner transfer mechanism for the donor web 16 illustrated in FIG. 1 is an immersion technique where the doner web is pulled into a pile or bath of magnetic toner 12 on one side of done web roller 22 and out of the toner on the other. This type of toner development is acceptable for the doner web 16 as what is needed is a uniform coverage of the entire doner web.

Other techniques for toning magnetic patterns, such as those discussed in the prior art sections, could be used for this step of the process as there is no background problem at this point in the process and the necessity is to transport as much toner in as uniform fashion as possible.

The magnetization pattern of thee doner web 16 causes the toner particulate 24 to adhere thereto and to remain on the web until it it transported into the transfer area 12. The magnetization pattern of the doner web is similar to that of the imaged areas of the copy web and comprises alternating magnetizations of a specific spatial wavelength and frequency. However, the doner web magnetizations are of a different wavelength to produce a weaker magnetic force than that of the copy web 2.

In a preferred form the alternations are formed widthwise across the doner web and parallel to the magnetization patterns in the copy web, although this is not a necessity for the operability of the invention. It should be apparent that the alternating magnetic microfields in the doner web may, as was explained previously in relation to the copy web pattern, be formed in numerous ways.

The numerous microfields in the doner web provide fringing fields for the toner 24 to adhere to and produce a substantially uniform toner coverage on the doner web 16. This is an important aspect of the invention as the doner web 16 constantly transports an endless supply of toner in even quantities into the toner transfer area 12. This allows uniform development of a latent magnetic image without under toning or over toning the copy web 2.

Once in the transfer area 12, the stronger magnetic forces of the copy web 2 transfers the toner particulate in imagewise configuration onto the copy web 2 while excess particulate remains on the doner web 16, in non-imagewise configuration. As erase head 14 is used to enhance this transfer process by demagnetizing the doner web 16 as it passes into the transfer area 12 before the toner transfer takes place. Alternatively, heating means 40 can be used to demagnetize doner web 16 by raising the temperature of web 16 above its Curie point. When the erase head 14 is used, a rewrite head 28 is provided to remagnetize the doner web 16 before it enters the toner reservoir 26.

As the latent magnetic image having the toner 24 adhered thereto moves out of the transfer area 12 it comes into contact with a copy sheet 23 which is held against the copy web 2 by a pair of pressure rollers 25 and 27. The magnetic toner transfers in imagewise configurtion from the copy web 2 to the copy sheet 23 under the influence of this pressure. The copy sheet is moved from the supply reel 31 to a takeup reel 29 in a continuous fashion to provide either multiple copies or individual images as the copy web 2 continues its endless path.

The copy sheet 23 may then have the toner 24 fixed to this surface in some manner, many of which are known in the art. Subsequently, the copy web 2 enters the recording station 10 once again where it can be erased and rewritten with another magnetic image or pass through to pick up or renew the toner supply from the toner transfer area 12 and continue on to the copy sheet 23 again for multiple copy capabilities.

While the imaging processes and apparatus illustrated in FIG. 1 are preferred for practicing the invention numerous adaptations are available. For example, both the copy web 2 and the doner web 16 could be cylindrical drums with a magnetic surface or a non-magneetic drum with an overlayer of magnetizable tape. Combinations are possible where the copy web 2 can be a drum and a donor web is used or where a copy web 2 is provided, a donor drum replaces the donor web for the transfer. The required structure is that a magnetizable surface capable of holding the latent magnetic image pattern and a magnetizable surface capable of holding the donor pattern be provided.

Figure 2A:
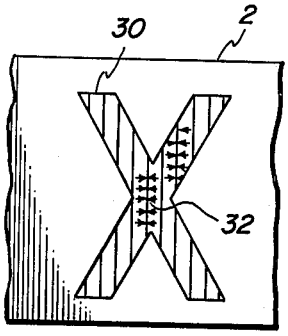
Figure 2B:
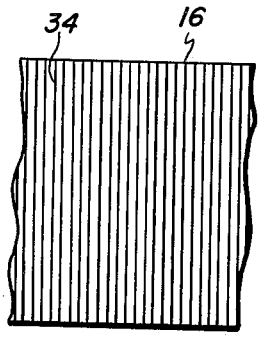

A portion of copy web 2 is illustrated in FIG. 2A where an image area 30 is shown with a magnetic recording pattern 32. The recording pattern 32 is actually a series of alternating magnetizations of a certain spatial wavelength and frequency. Where the magnetization sections oppose, fringing fields will be developed to attract the magnetic particular 24 thereto. The spatial frequency for the image magnetization reversals would be typically on the order of 25 - 100$\mu$. Likewise, in FIG. 2B there is shown a portion of the donor web 16 having a secnd magnetization pattern 34 recorded thereon. It is seen that the magnetization pattern 34 is comprised similarly of alternating domains having a certain spatial wavelength and frequency to produce fringing fields for the attraction of toner where the domains are in opposite. It should be particularly noted that the donor web 16 magnetization pattern 34 is of a differen wavelength than the magnetization pattern 32 of the copy web 2. Also it is preferred that the copy web 2 have a different coercivity and Curie Point temperature than the donor web 16 as will be more fully discussed herein below.

Figure 3A:
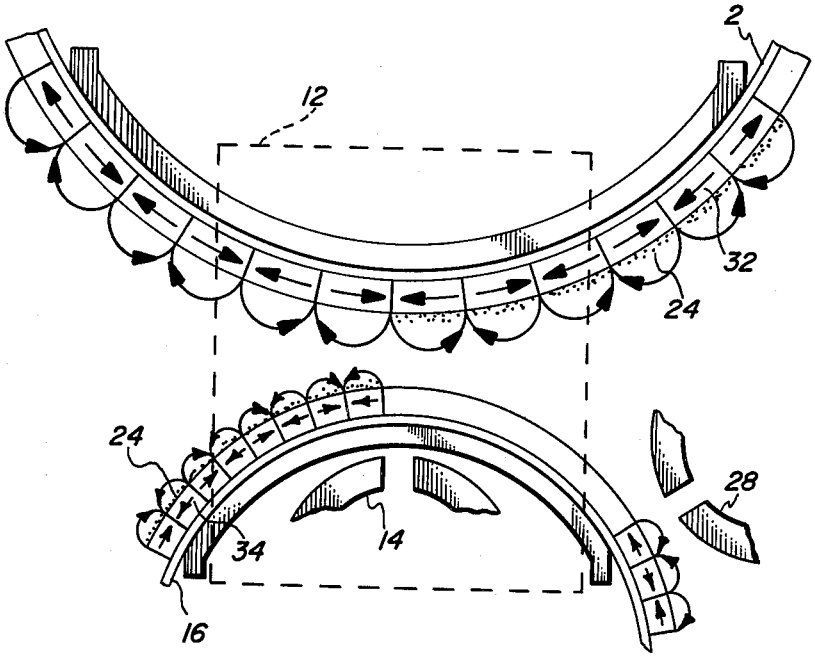

With reference now to FIG. 3 where is shown an enlargement of the toner transfer area 12 including the copy web 2 and the donor web 16. The alternations inn the magnetization domains of the pattern 32 are shown as the image area 30 and illustrate the field lines producing the fringing fields and the magnetic force lines that will cause the toner transfer. It is seen that the spatial wavelength of the image pattern 32 is different than that of magnetization pattern 34 to represent the greater attraction power. The field on the copy web is constructed to produce a differential in force to accelerate the particules adhering to the donor web onto the copy web in the image areas. Preferably, the copy web 2 as mentioned before has a greater coercivity than the donor web 16 to insure this effect.

In the uniform development of the copy web 2, the spacing separating the copy web 2 and the donor web 16 are important to the transfer process. For different spacings, the wavelength of the donor web will change as it will for different wavelengths of the image recorded on copy web 2. Table 1 is illustrative of the donor wavelength that must be recorded on the donor web 16 in relation to the copy web 2 spacing and image wavelength.

TABLE 1

| IW | DW d = 13$\mu$ | DW d = 18$\mu$ | DW d = 23$\mu$ |
|---|---|---|---|
| 25$\mu$ | $\geqq$162$\mu$ | | |
| 50$\mu$ | $\geqq$58$\mu$ | $\geqq$142$\mu$ | $\geqq$880$\mu$ |
| 70$\mu$ | $\geqq$55$\mu$ | $\geqq$108$\mu$ | $\geqq$241$\mu$ |
| 95$\mu$ | $\geqq$57$\mu$ | $\geqq$102$\mu$ | $\geqq$188$\mu$ |

It is understood that because there are no magnetization domains recorded in the non-imaged areas of the copy tape there are no force fields to accelerate the particles to the non-imaged areas. Thus, this non-contacting toning system solves many problems found in the art. A low background is maintained, therefore, by not depositing toner into these areas and consequently a much simpler clean up process than usual is permissible for the present system.

Also, the back of the copy tape 2 remains untoned so cleaning there is also unnecessary. Further, since the recorded pattern is weaker than that on the copy web 26 an amount of toner 24 corresponding to full development of the magnetic latent image may be loaded on it and transferred nearly uniformly onto the copy web 2.

For further enhancing the toner transfer to the copy web 2, a transfer head 14 may be used to erase the donor web microfields or to provide a neutralizing field opposite to the microfields recorded therein. The transfer head 14 then neutralizes the forces holding the toner 24 to the donor web 16 just prior to the transfer to the copy web 2. This assures there will be a larger net force produced by the gradient of the magnetization patterns 32 recorded on the copy web 2. The larger coercive force of the copy web 2 prevents erasure of the latent mangetic image during this process as only a magnetic field less than or equal to the coercivity of the donor web 16 is required by neutralization.

It should be realized that the erasures of the microfields in the doner web could also be accomplished by heating the donor web above its Curie point temperature thereby erasing the magnetization patterns 34 as does the transfer head 14. In such a manner though the Curie temperature of the copy web 2 should be above the Curie temperature of the donor web to prevent erasure of the imaged area. In both such cases a re-recording or write head 28 is positioned in proximity to the tape to allow for the re-recording of the microfields on the magnetizable surface of the donor web 16 in the aforementioned pattern.

Figure 3B:
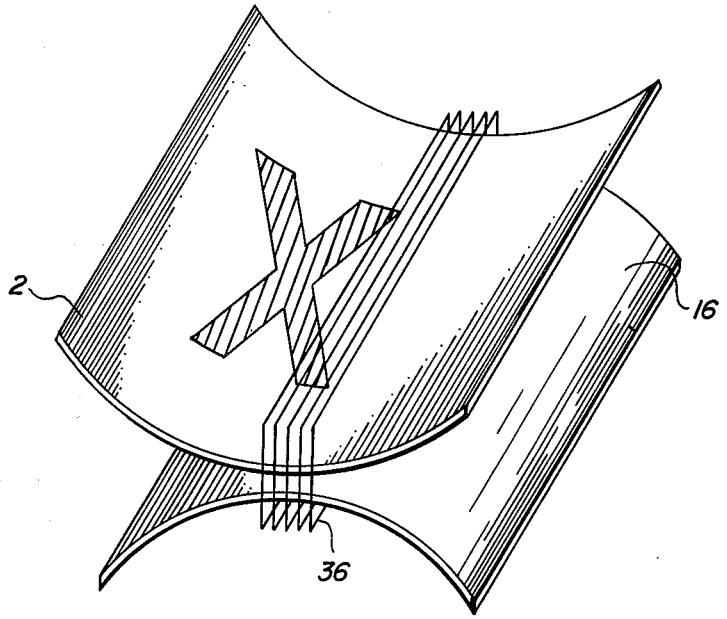

Turning now to FIG. 3B another embodiment of the present invention is illustrated where the copy web 2 and the donor web 16 perform their ferromagnetic transfer in the presence of a coil 36. The coil again acts to selectively erase or neutralize the microfields of the donor web 16 while not effecting the field grandients of the copy web 2. It is understood that either an a.c. or a d.c. current may be used to provide a magnetization in the correct direction to perform this neutralization. If an a.c. field is used, the reversal of the fields may be helpful in that they to some extent strobe the particles in the transfer back and forth between the two surfaces.

Figure 3C:
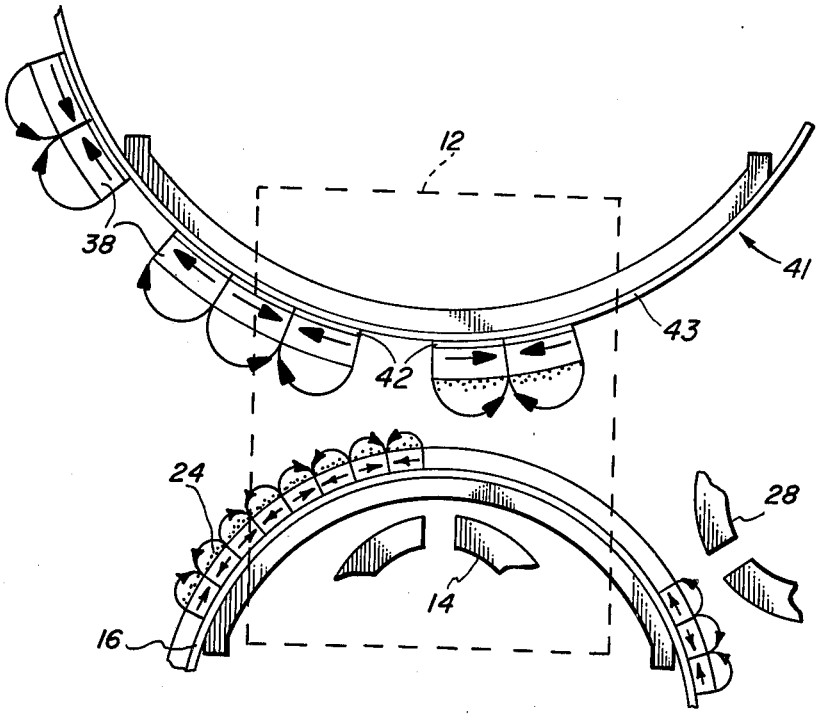

Another alternative embodiment of the imaging transfer system is illustrated in FIG. 3C where the copy drum 41 and the donor web 16 are brought into proximity in the transfer area 12. In this embodiment it is seen that the copy drum 41 is made of the non-magnetizable surface material 43 and that a magnetic or magnetizable 42 material is set thereon in a relief configuration forming an image 38. The image 38 in relief has been recorded with the first spatial wavelength of the inmage magnetization pattern and therefore will perform a similar transfer when brought into proxmity with the toner laden microfields of the donor web 16. The toner 24 transfers into the field gradients formed by the magnetic domain opposites of the relief image 38. Again the effect can be enhanced by the transfer head 14 and the donor web 16 may be re-recorded by the rewrite head 28.

While the invention has been described in detail in relation to a number of preferred embodiments those skilled in the art will understood that other changes in form and detail may be made therein without departing from the spirit and scope of the invention wherein all such changes obvious to one skilled in the art are encompassed in the following claims.

What is claimed is:

1. A method for developing a latent magnetic image on a magnetizable copy surface comprising the steps of:

forming a magnetic latent image on said magnetizable copy surface by alterating patterns of magnetization of a first spatial wavelength;

providing a magnetizable donor surface;

uniformly magnetizing said donor surface in alternating patterns of magnetization of a second spatial wavelength, whereby said first magnetization pattern produces a magnetic field stronger than said second magnetization pattern;

attracting magnetic toner to the alterating magnetization pattern of said donor surface;

transporting said donor surface substantially uniformly laden with said magnetic tonor into noncnducting proximity with said copy surface, whereby said toner is transferred from said donor surface to said image area of the copy surface under the influence of the stronger magnetic field of the image area.

2. The method as defined in claim 1 comprising the additional steps of;

demagnetizing said donor surface while in the proximity of the copy surface to enhance the toner transfer process, and remagnetizing said donor web with the second spatial wavelength subsequent to the toner transfer.

3. In a magnatic imaging system including a station for forming a latent magnetic image as alternating patterns of magnetizations of a first spatical wavelength in a magnetizable copy surface, a toner station for decorating said magnetic image with a ferromagnetic particulate, and a transfer station for transferring said decorated image to a copy sheet; said magnetic imaging system being characterized by an improved toner station comprising;

a magnetizablee donor surface;

means for uniformly magnetizing said donor surface with an alternating pattern of magnetization of a second wavelength, a reservoir of ferromagnetic particulate for decorating said latent magnetic image;

means for transferring said particulate to said donor surface whereby said particulate is adhered to substantially said entire donor surface by the second alternating pattern of magnetizations;

means for transporting said particulate laden donor surface into non-contacting proximity to said copy surface containing the latent magnetic image, whereby the particulate transfers to the image areas of the copy surface and remains adhered to the donor surface in non-image areas.

4. A magnetic imaging system as defined in claim 3 which further comprises;

means for erasing said donor surface magnetization pattern prior to the particulate transfer; and a rewriting means for remagnizaging said donor surface subsequent to said particulate transfer.

5. A magnetic imaging system as defined in claim 4 wherein the coercivity of the copy surface is greater than that of the donor surface.

6. A magnetic imaging system as defined in claim 5 wherein said erasing means includes an erase head driven by a high frequency current.

7. A magnetic imaging system as defined in claim 6 wherein said rewriting means includes a write head driven by a high frequency current.

8. A magnetic imaging system as defined in claim 5 wherein said erasing means includes;

means for heating said donor surface beyond its Curie temperature while not under the influence of external magnetic fields.

9. A magnetic imaging system as defined in claim 8 wherein said rewriting means includes:

means for heating said donor surface beyond its Curie tempeature, and means for cooling said donor surface while under the influence of an external magnetic field having said second spatial wavelength.

10. A magnetic imaging system as defined in claim 5 wherein said erasing means are a coil wound such that a magnetic field produced by a high frequency current driven therethrough will erase said donor surface.

11. A magnetic imaging system as defined in claim 3 wherein said means for transferring said particulate to the door surface includes:

means for suspending the particulate in a volatile liquid medium; and means for immersing said donor surface into said suspension, whereby the magnetization pattern of donor surface causes particulate to adhere thereto.

12. A magnetic imaging system as defined in claim 3 wherein said copy surface is an endless tape entrained about means for tape transporting.

13. A magnetic imaging system as defined in claim 12 wherein said donor surface in an endless tape entrained about means for tape transporting.

14. A magnetic imaging system as defined in claim 3 wherein said copy surfce is a drum having a magnetizable surface and means for the rotation of said drum surface.

15. A magnetic imaging system as defined in claim 14 wherein said donor surface is a drum having a magnetizable surface and means for rotating said drum surface.

16. A magnetic imaging system as defined in claim 3 wherein said copy surface is an imagewise configuration in relief on a non-magnetizable surface.

17. A magnetic imaging system as defined in claim 16 wherein said non-magnetizable surface is a drum including means to rotate the drum surface.

18. A magnetic imaging surface as defined in claim 16 wherein said non-magnetic surface is an endless web entrained about means for web transporting.

19. A magnetic imaging system as defined in claim 3 wherin said means for transferring said particulate to the donor surface includes;

means for conveying the particulate from the reservoir;

means co-operating with said conveying means for cascading said particulate over said donor surface containing said alternating magnetization patterns of the second spatial wavelength, said cascading means so positioned that excess particulate will fall back into the reservoir by gravitational forces.

20. A toner system for decorating a magnetic latent image of a surface comprising:

a magnetizable donor surface having a magnetic field wherein the force of said magnetic latent image is stronger than that of said doner field;

means for uniformly toning substantially all of said donor surface with a transferable means magnetic toner particulate;

means for transporting said donor surface into non-contacting proximity of said magnetic latent image surface whereby said stronger image field will cause the toner particulate to transfer.

21. A magnetic latent image toner system as defined in claim 20 wherein:

said magnetic latent image field is produced by alternating patterns of magnetization having a first spatial wavelength;

said donor magnetic field is produced by alternating patterns of magnetization having a second spatial wavelength.

22. A magnetic latent image toner system as defined in claim 21 wherein the first spatial wavelength is greater than the second spatical wavelength.

23. A magnetic latent image toner system as defined in claim 22 wherein the first spatial wavelength is less than the second spatial wavelength.

24. A magnetic latent image toner system as defined in claim 21 wherein the coercivity of the latent magnetic image surface is greater than the coercivity of the donor surface.

25. A magnetic latent image toner system as defined in claim 24 wherein said latent magnetic image surface coercivity is in the range of 200–600 Oersteds.

26. A magnetic latent image toner system as defined in claim 25 wherein said donor surface coercivity is in the range of 200–600 Oersteds.

* * * * *

UNITED STATES PATENT AND TRADEMARK OFFICE

CERTIFICATE OF CORRECTION

PATENT NO. : 4,038,665

DATED : July 26, 1977

INVENTOR(S) : Armand P. Neukermans

It is certified that error appears in the above-identified patent and that said Letters Patent are hereby corrected as shown below:

In column 7, line 45, delete "alterating" and substitute --alternating--.

In column 7, line 53, delete "alterating" and substitute --alternating--.

In column 7, line 57, delete "cnducting" and substitute --conducting--.

In column 8, line 1, delete "magnatic" and substitute --magnetic--.

In column 8, line 10, delete "magnetizablee" and substitute --magnetizable--.

In column 9, line 5, delete "surfce" and substitute --surface--.

In column 10, line 21, delete "spatical" and substitute --spatial--.

Signed and Sealed this

*Eighteenth* Day of *October 1977*

[SEAL]

*Attest:*

RUTH C. MASON
*Attesting Officer*

LUTRELLE F. PARKER
*Acting Commissioner of Patents and Trademarks*